US011268518B2

(12) United States Patent
Semple et al.

(10) Patent No.: US 11,268,518 B2
(45) Date of Patent: Mar. 8, 2022

(54) ISOLATED CHAMBER FOR MECHANICAL FACE SEAL LEAKAGE IN SUBMERSIBLE WELL PUMP ASSEMBLY

(71) Applicant: Baker Hughes Oilfield Operations LLC, Houston, TX (US)

(72) Inventors: Ryan Semple, Owasso, OK (US); David Tanner, Broken Arrow, OK (US); Ignacio Martinez, Tulsa, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 233 days.

(21) Appl. No.: 16/574,435

(22) Filed: Sep. 18, 2019

(65) Prior Publication Data

US 2020/0095992 A1 Mar. 26, 2020

Related U.S. Application Data

(60) Provisional application No. 62/855,060, filed on May 31, 2019, provisional application No. 62/734,179, filed on Sep. 20, 2018.

(51) Int. Cl.

| | |
|---|---|
| ***F04D 13/06*** | (2006.01) |
| ***F04D 29/10*** | (2006.01) |
| ***F04D 13/10*** | (2006.01) |
| ***F04C 13/00*** | (2006.01) |
| ***E21B 43/12*** | (2006.01) |

(52) U.S. Cl.

CPC ..... *F04D 13/10* (2013.01); *E21B 43/128* (2013.01); *F04C 13/008* (2013.01); *F04D 13/062* (2013.01); *F04D 29/108* (2013.01)

(58) Field of Classification Search

CPC ..... F04D 13/008; F04D 13/062; F04D 13/10; F04D 29/108; F04D 29/128; E21B 43/128

See application file for complete search history.

(56) References Cited

U.S. PATENT DOCUMENTS 4,421,999 A 12/1983 Beavers et al.
6,201,327 B1 * 3/2001 Rivas ..... F04D 13/062 310/87

(Continued)

OTHER PUBLICATIONS

International Search Report and Written Opinion of PCT Application No. PCT/US2019/051784 dated Jan. 6, 2020: pp. 1-10.

*Primary Examiner* — Charles G Freay

(74) *Attorney, Agent, or Firm* — Bracewell LLP; Keith Derrington

(57) ABSTRACT

A submersible pump assembly includes a seal section connected to a motor, the seal section having a housing with an outboard bearing at a housing pump end in radial supporting engagement with a drive shaft. An inboard bearing is also in the housing pump end, axially spaced from the outboard bearing, and in radial supporting engagement with the shaft. A barrier fluid chamber in the housing pump end contains a barrier fluid. A primary shaft seal is located within the barrier fluid chamber and seals the barrier fluid in the barrier fluid chamber from the motor lubricant. A secondary shaft seal is mounted in the barrier fluid chamber between the primary shaft seal and the outboard bearing. The secondary shaft seal seals the barrier fluid in the barrier fluid chamber from well fluid exterior of the housing pump end.

19 Claims, 2 Drawing Sheets

(56) References Cited

U.S. PATENT DOCUMENTS

| | | | |
|---|---|---|---|
| 7,665,975 | B2 | 2/2010 | Parmeter et al. |
| 7,708,534 | B2 | 5/2010 | Parmeter et al. |
| 8,807,966 | B2 | 8/2014 | Du et al. |
| 8,932,034 | B2 | 1/2015 | McKinney et al. |
| 9,353,752 | B2 | 5/2016 | Tetzlaff et al. |
| 9,995,118 | B2 | 6/2018 | Tanner et al. |
| 2007/0140876 | A1 | 6/2007 | Parmeter et al. |
| 2009/0010773 | A1 | 1/2009 | Parmeter et al. |
| 2013/0004344 | A1 | 1/2013 | McKinney et al. |
| 2017/0037861 | A1 | 2/2017 | Rutter et al. |
| 2018/0202271 | A1 | 7/2018 | Semple et al. |

* cited by examiner

ISOLATED CHAMBER FOR MECHANICAL FACE SEAL LEAKAGE IN SUBMERSIBLE WELL PUMP ASSEMBLY

CROSS-REFERENCE TO RELATED APPLICATIONS

This application claims the benefit of provisional applications 62/855,060, filed May 31, 2019 and 62/734,179, filed Sep. 20, 2018.

FIELD OF DISCLOSURE

The present disclosure relates to electrical submersible well pump assemblies, and in particular to mechanical face shaft seals within an isolated barrier fluid chamber to mitigate well fluid contamination with motor lubricant, and inboard and outboard bearings to maintain the shaft straight in the shaft seal area.

BACKGROUND

Electrical submersible pumps (ESP) are commonly used in hydrocarbon producing wells. An ESP includes a pump driven by an electrical motor filled with a motor lubricant. A seal section connected between the motor and the pump has a shaft seal to retard the entry of well fluid into contamination with the motor lubricant. The shaft seal is normally a mechanical face seal. The seal section also typically has a pressure equalizer that reduces a pressure differential between the motor lubricant and exterior well fluid. Radial bearings at the upper and lower ends of the seal section provide radial support for the shaft.

These seal sections work well. However, a small amount of well fluid tends to leak past the shaft seal into contamination with the motor lubricant. Well fluid within the interior of the motor can be very damaging.

SUMMARY

A submersible pump assembly has a motor for driving a pump of the pump assembly. The motor contains a dielectric motor lubricant. A seal section operatively connects to the motor. The seal section has a housing having a housing motor end, a housing pump end, and a longitudinal axis. A coaxial shaft in the housing is driven by the motor. A motor lubricant equalizing chamber is in an annular space around the shaft axially between the housing pump end and the housing motor end. A motor lubricant equalizer in the motor lubricant equalizing chamber reduces a pressure differential between well fluid admitted to the motor lubricant equalizing chamber and the motor lubricant in the motor. An outboard bearing in the housing pump end is in radial supporting engagement with the shaft. An inboard bearing in the housing pump end is axially spaced from the outboard bearing and in radial supporting engagement with the shaft. A primary shaft seal in the housing pump end is in sealing engagement with the shaft, the primary shaft seal being axially between the outboard bearing and the inboard bearing.

A motor lubricant communication passage extends from the motor through the housing motor end, the motor lubricant equalizing chamber, into the housing pump end, through the inboard bearing and to a motor lubricant side of the primary shaft seal.

In one embodiment, the outboard bearing is rigidly mounted in the housing pump end. In that embodiment, the inboard bearing is mounted in the housing pump end for limited radial compliant movement relative to the housing pump end.

More specifically, the housing pump end has an outboard receptacle and an inboard receptacle in a shaft passage extending through the housing pump end. The outboard bearing comprises an outboard bushing rigidly mounted within the outboard receptacle for non-rotation within the outboard receptacle. The inboard bearing comprises an inboard bushing in non-rotating engagement with the inboard receptacle. A resilient member between a circumferential exterior of the inboard bushing and a circumferential interior of the inboard receptacle allows limited radial movement of the inboard bushing within the inboard receptacle.

The resilient member may be an annular elastomeric member deformed between a circumferential exterior of the inboard bushing and the inboard receptacle. The elastomeric member allows limited radial movement of the inboard bushing within the inboard receptacle.

In the embodiment shown, a barrier fluid chamber containing a barrier fluid is in the housing pump end. The shaft extends through the barrier fluid chamber. The primary shaft seal is located within the barrier fluid chamber and seals the barrier fluid in the barrier fluid chamber from the motor lubricant. A secondary shaft seal is mounted in the barrier fluid chamber between the primary shaft seal and the outboard bearing. The secondary shaft seal seals the barrier fluid in the barrier fluid chamber from well fluid exterior of the housing pump end. A barrier fluid equalizer has one side in contact with the barrier fluid in the barrier fluid chamber for reducing a pressure differential between the barrier fluid and well fluid on the exterior of the housing pump end. The barrier fluid may have a higher specific gravity than the motor lubricant.

The primary and secondary shaft seals may be mechanical face seals that are inverted relative to each other.

The barrier fluid equalizer may be a bellows with a spring rate and configuration to apply a positive pressure to the barrier fluid chamber that is greater than well fluid pressure on the exterior of the housing pump end.

Figure 1:
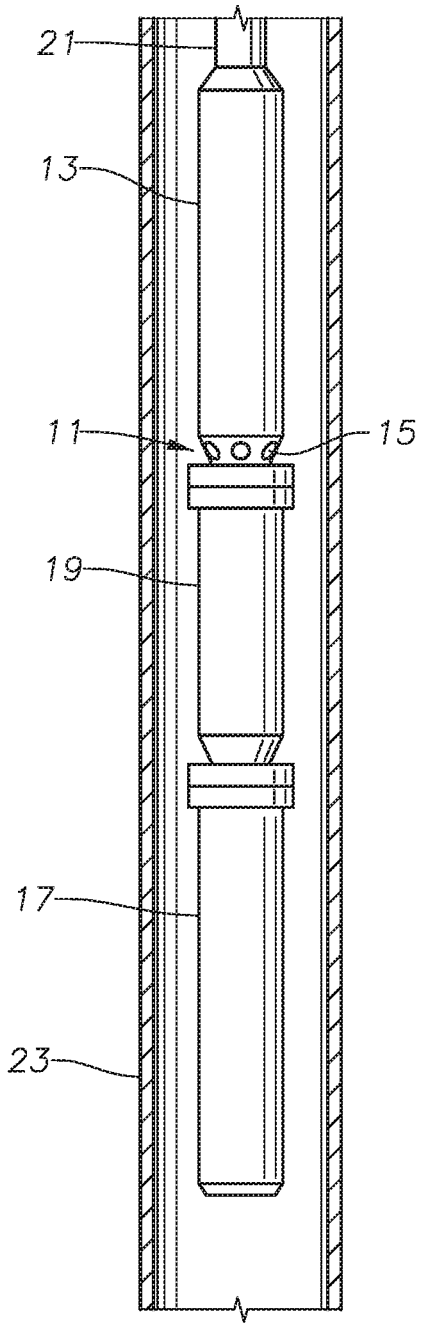
FIG. 1 is a side view of an electrical submersible pump (ESP) having a seal section in accordance with this disclosure.

While the disclosure will be described in connection with the preferred embodiments, it will be understood that it is not intended to limit the disclosure to that embodiment. On the contrary, it is intended to cover all alternatives, modifications, and equivalents, as may be included within the scope of the claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates an electrical submersible well pump (ESP) 11 of a type commonly used to lift hydrocarbon production fluids from wells. ESP 11 has a centrifugal pump 13 with intake ports 15 for drawing in well fluid. Pump 13 could be made up of several similar pumps secured together in tandem by threaded fasteners or bolts, with intake ports 15 being in the lowermost pump. Intake ports 15 could also be in a separate module connected to pump 13. Further, if a rotary gas separator is employed below pump 13, intake ports 15 would be in the gas separator.

An electrical motor 17 is operatively mounted to and drives pump 13. Motor 17 contains a dielectric motor lubricant for lubricating the bearings within. A pressure equalizer or seal section 19 communicates with the lubricant in motor 17 and with the well fluid for reducing a pressure differential between the lubricant in motor 17 and the exterior well fluid. In this example, the pressure equalizing portion of seal section 19 locates between motor 17 and pump intake ports 15. Alternately, the pressure equalizer portion of seal section 19 could be located below motor 17, and other portions of seal section 19 could be above motor 17. The terms "upward", "downward", "above", "below" and the like are used only for convenience as ESP 11 may be operated in other orientations, such as horizontal.

A string of production tubing 21 suspended within casing 23 supports ESP 11. In this example, pump 13 discharges into production tubing 21. Alternately, coiled tubing could support ESP 11, in which case pump 13 would discharge into the annulus around the coiled tubing. Motor 17 in that case would be located above pump 13. The power cable for motor 17 would be within the coiled tubing instead of alongside production tubing 21.

Figure 2:
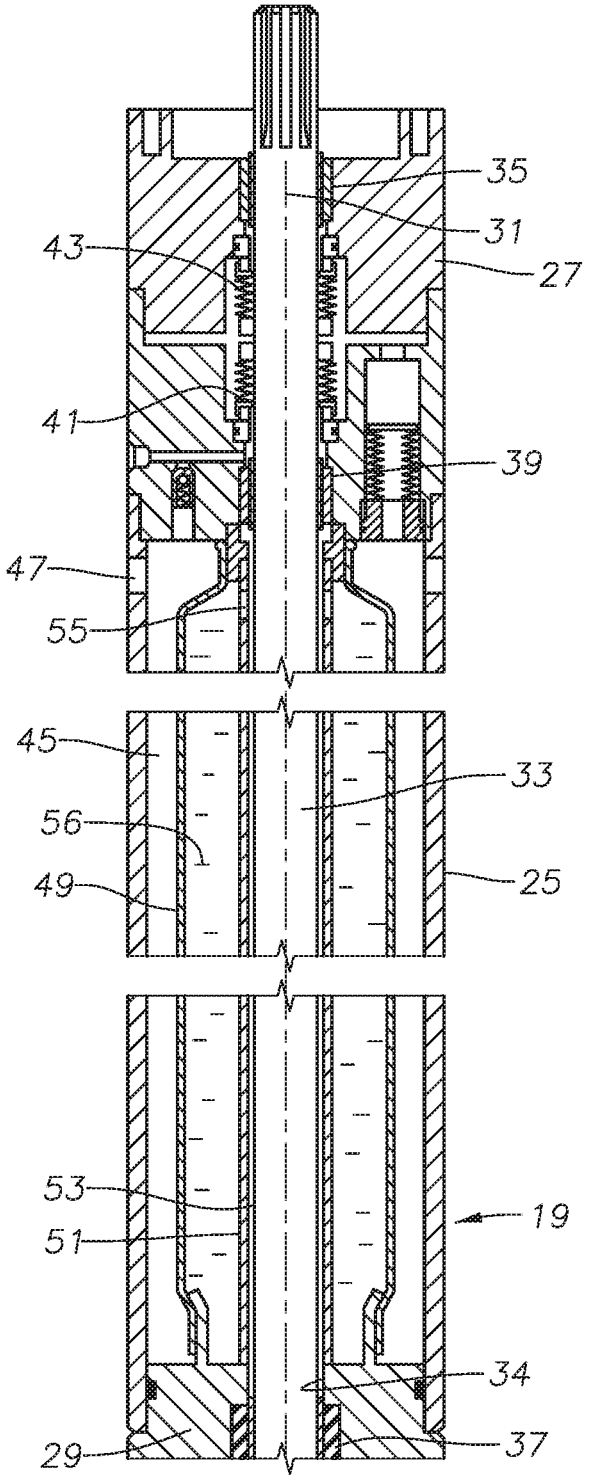
FIG. 2 is an axial sectional view of the seal section of FIG. 1.

Referring to FIG. 2, seal section 19 has a tubular housing 25 that includes a head or pump end 27 and a base or motor end 29, each secured by threads to the tubular portion of housing 25. When connected into ESP 11 (FIG. 1), housing pump end 27 will be closer to pump 13 than it is to motor 17 and may be directly connected to the end of pump 13 having intake ports 15. Similarly, housing motor end 29 will be closer to motor 17 than it is to pump 13 and may be connected directly to motor 17. Alternately, housing motor end 29 could be connected to another seal section in tandem or to other pressure equalizing portions of seal section 19. In this example, housing pump end 27 comprises an upper portion 27*a* and a lower portion 27*b*, secured together by threads.

Housing 25 has a longitudinal axis 31 extending concentrically through housing pump end 27 and housing motor end 29. A drive shaft 33 with splined ends is rotated by motor 17 (FIG. 1) and extends along axis 31 through shaft passages 34 in housing pump end 27 and housing motor end 29. An outboard bearing 35 radially supports shaft 33 at the upper end of housing pump end 27. A motor end bearing 37 radially supports shaft 33 at the lower end of housing motor end 29. In this embodiment, an inboard bearing 39 in pump end 27 below outboard bearing 35 also provides radial support for shaft 33.

Also, in this embodiment, a primary shaft seal 41 and a secondary shaft seal 43 seal around shaft 33 within housing pump end 27. Both primary shaft seal 41 and secondary shaft seal 43 are located axially between outboard bearing 35 and inboard bearing 39 in this embodiment.

Housing 25 has a motor lubricant equalizing chamber 45 located between housing pump end 27 and housing motor end 29. A well fluid port 47 admits well fluid into motor lubricant equalizing chamber 45. Motor lubricant equalizing chamber 45 has an equalizer, which in this example comprises a flexible bag or container 49. Alternately, bellows or labyrinth tubes and other labyrinth arrangements may serve as equalizers. The lower end of bag 49 seals to housing motor end 29, and the upper end of bag 49 is in a sealing arrangement with housing pump end 27.

A guide tube 51 extends coaxially through bag 49 around shaft 33. Guide tube 51 has a lower end sealed to housing motor end 29 around shaft passage 34. Guide tube 51 has an upper end sealed to housing pump end 27 around the portion of shaft passage 34 in housing pump end 27. Guide tube 51 has a larger inner diameter than an outer diameter of shaft 33, creating a shaft annulus 53 between shaft 33 and guide tube 51. In this example, one or more guide tube ports 55 extend through the side wall of guide tube 51 near housing pump end 27.

Motor lubricant 56 in motor 17 (FIG. 1) is free to flow along a communication path into the interior of bag 49. The communication path passes through housing motor end bearing 37, shaft annulus 53 and guide tube ports 55. The communication path also allows motor lubricant 56 to pass through inboard bearing 39 up to primary shaft seal 41. Bag 49 will substantially equalize the pressure of motor lubricant 49 in motor 17 with the hydrostatic well fluid pressure.

Figure 3:
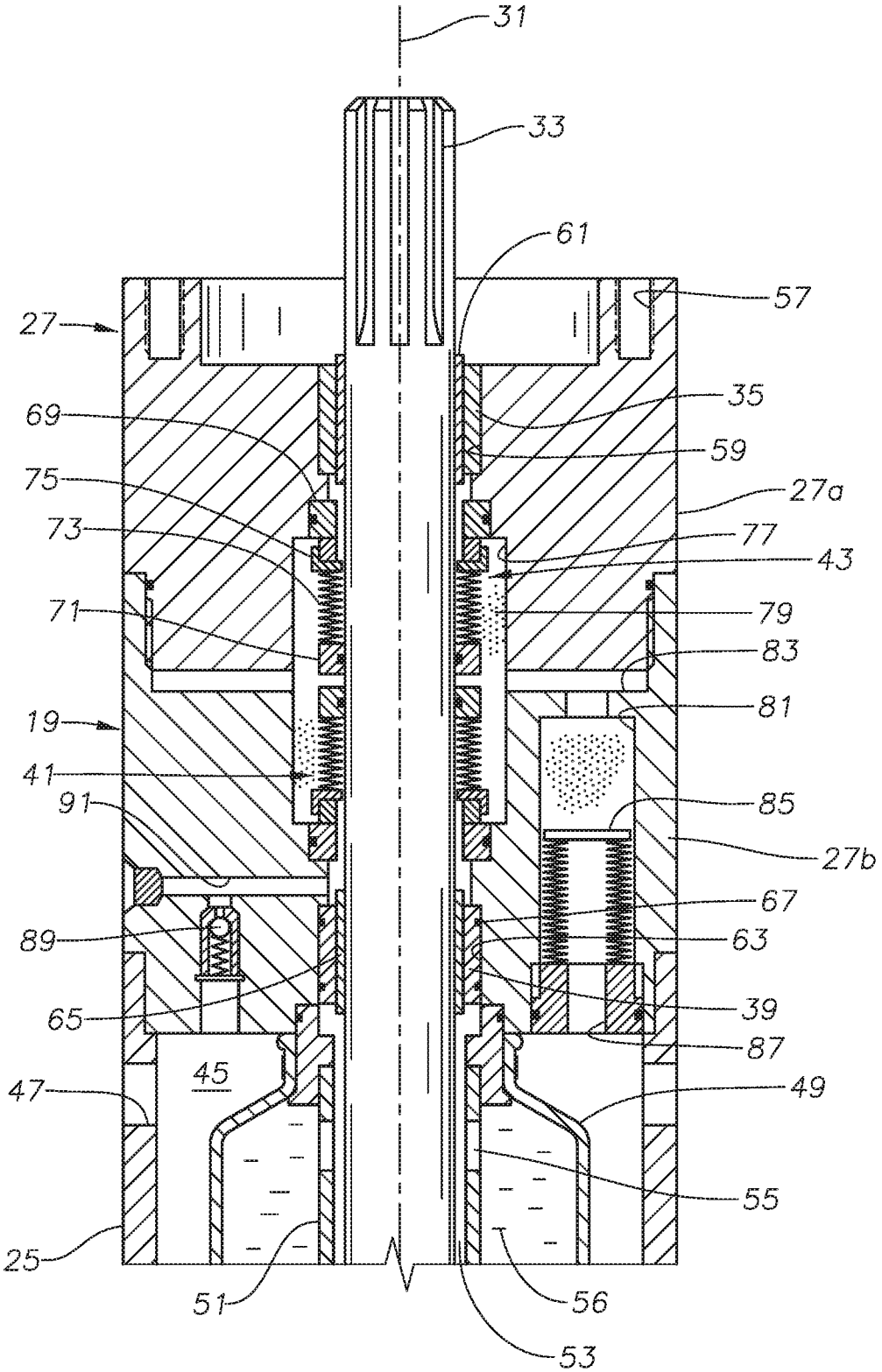
FIG. 3 is a sectional view of an upper portion of the seal section of FIG. 2.

Referring to FIG. 3, which more clearly illustrates the upper portion of seal section 19, threaded bolt holes 57 may be formed in the upper portion 27*a* of housing pump end 27 for connecting seal section 19 to another module, such as pump 13 (FIG. 1). Alternately, the connection could be made by a rotatable threaded collar.

Shaft passage 34 has an outboard bearing receptacle 59 formed at the upper end of housing pump end portion 27*a*. In this embodiment, outboard bearing 35 comprises a bushing that rigidly fits, such as by a press or interference fit, within outboard bearing receptacle 59. Outboard bearing 35 may be formed of a hard, wear resistant material such as tungsten carbide. Shaft 33 has an outboard bearing sleeve 61 secured for rotation to it, such as by a key and slot arrangement. Outboard bearing sleeve 61 is in rotating, sliding engagement with the inner diameter of outboard bearing 35. Outboard bearing sleeve 61 may also be formed from a hard, wear resistant material.

Similarly, shaft passage 34 has an inboard bearing receptacle 63 formed at the lower end of housing pump end portion 27*b*. In this embodiment, inboard bearing 39 comprises a bushing that fits with radial compliance in inboard bearing receptacle 63. That is, inboard bearing 39 can move radially a limited amount relative to inboard bearing receptacle 63. An inboard bearing sleeve 65, secured to shaft 33 for rotation therewith, rotates slidingly within inboard bearing 39. Inboard bearing 39 and inboard bearing sleeve 65 also may be formed of a hard material such as tungsten carbide. The outer diameter of inboard bearing 39 is selected to be less than the inner diameter of inboard receptacle 39 to accommodate this compliant radial movement. One or more resilient members 67 are located between the outer diameter of inboard bearing 39 and the inner diameter of inboard bearing receptacle 63. In this example, resilient members 67 comprise two elastomeric rings encircling inboard bearing 39. Resilient members 67 could seal as well, but need not do so.

In this embodiment, primary and secondary shaft seals 41, 43 are mechanical face seals that may be conventional and identical to each other. Each shaft seal 41, 43 has a non-rotating base 69, which is a circular, flat disc mounted for non-rotation in a portion of shaft passage 34. Each shaft seal 41, 43 has a retainer 71 rigidly attached to shaft 33 for rotation therewith. A diaphragm or boot 73, which may be a metal bellows, joins a runner 75 to retainer 71. Diaphragm 73 is resilient and urges runner 75 against base 69 in a sliding and sealing engagement.

Also, in this embodiment, shaft seals 41, 43 are inverted relative to each other. That is, base 69 of secondary shaft seal 43 is secured in a counterbore in passage 34 a short distance below outboard bearing 35. Base 69 of secondary shaft seal 43 is thus above retainer 71 of secondary shaft seal 43. Base 69 of primary shaft seal 41 is secured in a counterbore in passage 34 a short distance above inboard bearing 39. Base 69 of primary shaft seal 41 is thus below retainer 71 of primary shaft seal 41. The retainers 71 of shaft seals 41, 43 are closely spaced to each other but need not touch.

In this embodiment, part of shaft passage 34 within housing pump end 27 comprises a barrier fluid chamber 77. Both primary and secondary shaft seals 41, 43 are located within barrier fluid chamber 77. Barrier fluid chamber 77 is formed in this example by mating engagement of housing pump end upper portion 27*a* with housing pump end lower portion 27*b*. Barrier fluid chamber 77 could alternately be formed in other ways, such as by additive manufacturing or three-dimensional printing of housing pump end 27 instead of having separate upper and lower portions 27*a*, 27*b*.

A blocking or barrier fluid 79 will be introduced into barrier fluid chamber 77 prior to installing ESP 11. Barrier fluid 79 could be the same as motor lubricant 56, but in this embodiment barrier fluid 79 is a different dielectric liquid, one having a higher specific gravity than well fluid or motor lubricant 56. The greater density and weight than well fluid plus relative immiscibility causes the well fluid to tend to float on top of the barrier fluid 79. One suitable type of barrier fluid 79 is a perfluoropolyether (PFPE) oil. PFPE has a specific gravity of 1.94. In this embodiment, barrier fluids 79 having a specific gravity of at least 1.2 are preferred. Motor lubricant 56 typically has a specific gravity of about 0.84 to 0.86. The specific gravities of well fluids range from 0.78 (API 50 degrees) to 1.00 (API 10 degrees). The lower specific gravity is for light crude oil, and the higher specific gravity is for water or extra heavy crude oil.

The sliding engagement of runner 75 against base 69 of secondary shaft seal 43 seals against the entry of well fluid into barrier fluid chamber 77. However, some leakage of well fluid past secondary shaft seal 43 may occur, contaminating the purity of barrier fluid 79. The sliding engagement of runner 75 against base 69 of primary shaft seal 41 seals against the entry of barrier fluid 79 into contact with motor lubricant 56 in shaft passage 34, providing a second barrier to well fluid contamination with motor lubricant 56.

Primary shaft seal 41 defines a lower or motor end of barrier fluid chamber 77, and secondary shaft seal 43 defines an upper or pump end of barrier fluid chamber 77. The exteriors of diaphragms 73 of both shaft seals 41, 43 are immersed in barrier fluid 79 in this embodiment. The interior of diaphragm 73 of secondary shaft seal 43 is filled with well fluid. The interior of diaphragm 73 of primary shaft seal 41 is filled with motor lubricant 56.

Barrier fluid chamber 77 includes a barrier fluid bellows chamber 81. In this example, barrier fluid bellows chamber 81 is offset from axis 31 and in communication with barrier fluid chamber 77 by a barrier fluid passage 83. Barrier fluid passage 83 may comprise a gap between a lower side of pump end upper portion 27*a* and an upper side of pump end lower portion 27*b*.

A small resilient bellows 85 moves between contracted and extended positions within barrier fluid bellows chamber 81. In this embodiment, a port 87 leads to the interior of bellows 85 from the portion of motor lubricant equalizing chamber 45 containing well fluid. Bellows 85 may be a flexible, metal canister with corrugated sides and a closed upper end.

In this embodiment, bellows 85 is in a partially or fully compressed state when ESP 11 is installed in the well. The spring rate of bellows 85 is selected to cause a positive pressure in barrier fluid bellows chamber 81 and barrier fluid chamber 77. The positive pressure, which may be up to 10 psi, causes barrier fluid chamber 77 to have a slightly higher pressure than well fluid pressure exterior of seal section 19. The positive pressure will also be slightly higher than the pressure of motor lubricant 56 in bag 49. The positive pressure in barrier fluid chamber 77 minimizes well fluid intrusion into barrier fluid chamber 77 due to leakage past secondary seal 43. The low positive pressure also minimizes leakage of barrier fluid 79 out of barrier fluid chamber 77 past primary and secondary seals 41, 43.

Alternately, it is feasible to select a spring rate for bellows 85 that causes bellows 85 to be in an extended position when ESP 11 is lowered into the well, rather than contracted. This arrangement would create a slightly negative pressure in barrier fluid chamber 77, less than the hydrostatic pressure of well fluid on the exterior. A slightly negative pressure in barrier fluid chamber 77 when ESP 11 is first lowered into the well would possibly extend the operating range of pressures and temperatures that barrier fluid chamber 77 could operate in.

As an alternate to the interior of bellows 85 being filled with well fluid, porting from the portion of shaft passage 34 containing inboard bearing 39 could provide motor lubricant 56 to the interior of bellows 87. If so, during operation, as motor 17 heats motor lubricant 56, the expansion of motor lubricant 56 may create a slight bias to keep barrier fluid chamber 77 at a slightly higher pressure than the well fluid in the well bore. This slightly higher pressure during operation tends to prevent well fluid from leaking inward past secondary seal 43 into barrier fluid chamber 77. In this alternative, bellows 85 would likely not be arranged to create a positive pressure in barrier fluid chamber 77.

A check valve 89, which may be conventional, is located in a check valve passage 91 that leads from shaft passage 34 between primary shaft seal 41 and inboard bearing 39. Check valve passage 91 has an outlet in motor lubricant equalizing chamber 45. After ESP 11 is deployed, operating motor 17 causes motor lubricant 56 to heat and expand. The expansion forces excess motor lubricant 56 in bag 49 out check valve 89 into lubricant equalizing chamber 45, which is open to well fluid.

During operation, outboard and inboard bearings 35, 39 provide support for shaft 33 to maintain the straightness of shaft 33 where sealed by primary and secondary shaft seals 41, 43. The radial compliance of inboard bearing 39 accommodates slight variances in the straightness of this portion of shaft 33. Outboard bearing 35 will be immersed in well fluid, and inboard bearing 39 will be immersed in motor lubricant 56. Secondary shaft seal 43 seals against the entry of well fluid into barrier fluid chamber 77. Primary shaft seal 41 seals against the entry of barrier fluid 79 into motor lubricant 56. The isolated barrier fluid chamber 77 will contain substantially any leakage of well fluid past secondary shaft seal 43.

In the embodiment described, the high specific gravity of barrier fluid 79 causes well fluid that may leak into barrier fluid chamber 77 to gravitate to the top of barrier fluid chamber 77, further reducing the chance for well fluid to come into contact with motor lubricant 56. Because of the lower specific gravity of the motor lubricant 56, any well fluid that manages to enter bag 49 tends to settle in the lower portion of bag 49. Well fluid accumulating in the lower portion of bag 49 would have to migrate upward to port 55 of annulus 53 in order to reach motor 17. The lighter weight of motor lubricant 56 reduces the chances for upward migration of well fluid. In the embodiment described, the positive pressure applied by barrier fluid equalizer 85 to barrier fluid chamber 77 further reduces the chances for well fluid to leak past secondary seal 43 into barrier fluid chamber 79.

The present disclosure described herein, therefore, is well adapted to carry out the objects and attain the ends and advantages mentioned, as well as others inherent therein. While only a few embodiments of the disclosure have been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. A submersible pump assembly, comprising:

a motor for driving a pump of the pump assembly, the motor containing a dielectric motor lubricant;

a seal section operatively connected to the motor, the seal section comprising:

a housing having a housing motor end, a housing pump end, and a longitudinal axis;

a coaxial shaft in the housing that is driven by the motor;

a motor lubricant equalizing chamber axially between the housing pump end and the housing motor end;

a motor lubricant equalizer in the motor lubricant equalizing chamber for equalizing pressure of well fluid admitted to the motor lubricant equalizing chamber and the motor lubricant in the motor;

an outboard bearing comprising an outboard bushing and that is in the housing pump end in radial supporting engagement with the shaft;

an inboard bearing comprising an inboard bushing and that is in the housing pump end, axially spaced from the outboard bearing, and in radial supporting engagement with the shaft;

a primary shaft seal in the housing pump end in sealing engagement with the shaft, the primary shaft seal being axially between the outboard bearing and the inboard bearing;

an outboard receptacle in the housing pump end having the outboard bushing mounted within;

an inboard receptacle in the housing pump end having the inboard bushing mounted within; and a resilient member between a circumferential exterior of the inboard bushing and the inboard receptacle, the resilient member allowing limited radial movement of the inboard bushing within the inboard receptacle.

2. The assembly according to claim 1, further comprising: a motor lubricant communication passage extending from the motor through the housing motor end, the motor lubricant equalizing chamber, into the housing pump end, through the inboard bearing and to a motor lubricant side of the primary shaft seal.

3. The assembly according to claim 1, wherein: the outboard bearing is rigidly mounted in the housing pump end; and the inboard bearing is mounted in the housing pump end for limited radial compliant movement relative to the housing pump end.

4. The assembly according to claim 1, further comprising:

a barrier fluid chamber in the housing pump end, the shaft extending through the barrier fluid chamber, the barrier fluid chamber containing a barrier fluid; the primary shaft seal being located within the barrier fluid chamber and sealing the barrier fluid in the barrier fluid chamber from the motor lubricant; and a secondary shaft seal mounted in the barrier fluid chamber between the primary shaft seal and the outboard bearing, the secondary shaft seal sealing the barrier fluid in the barrier fluid chamber from well fluid exterior of the housing pump end.

5. The assembly according to claim 1, further comprising:

a barrier fluid chamber in the housing pump end, the shaft extending through the barrier fluid chamber, the barrier fluid chamber containing a barrier fluid; the primary shaft seal being located within the barrier fluid chamber and sealing the barrier fluid in the barrier fluid chamber from the motor lubricant;

a secondary shaft seal mounted in the barrier fluid chamber between the primary shaft seal and the outboard bearing, the secondary shaft seal sealing the barrier fluid in the barrier fluid chamber from well fluid exterior of the housing pump end; and wherein the barrier fluid has a higher specific gravity than the motor lubricant.

6. The assembly according to claim 1, further comprising:

a barrier fluid chamber in the housing pump end, the barrier fluid chamber containing a barrier fluid, the primary shaft seal being within the barrier fluid chamber and defining a motor end of the barrier fluid chamber, the motor end of the barrier fluid chamber being within the housing pump end; a secondary shaft seal mounted in the barrier fluid chamber between the primary shaft seal and the outboard bearing, the secondary shaft seal sealing the barrier fluid in the barrier fluid chamber from well fluid on the exterior of the housing pump end and defining a pump end of the barrier fluid chamber; and a barrier fluid equalizer having one side in contact with the barrier fluid in the barrier fluid chamber.

7. The assembly according to claim 1, further comprising:

a barrier fluid chamber in the housing pump end, the barrier fluid chamber containing a barrier fluid, the primary shaft seal being within the barrier fluid chamber and defining a motor end of the barrier fluid chamber, the motor end of the barrier fluid chamber being within the housing pump end;

a secondary shaft seal mounted in the barrier fluid chamber between the primary shaft seal and the outboard bearing, the secondary shaft seal sealing the barrier fluid in the barrier fluid chamber from well fluid on the exterior of the housing pump end and defining a pump end of the barrier fluid chamber;

a barrier fluid equalizer having one side in contact with the barrier fluid in the barrier fluid chamber and an opposite side for contact with well fluid; and wherein each of the primary and secondary shaft seals comprise mechanical face seals that are inverted relative to each other.

8. The assembly according to claim 1, further comprising:

a barrier fluid chamber in the housing pump end, the barrier fluid chamber containing a barrier fluid, the primary shaft seal being within the barrier fluid chamber and defining a motor end of the barrier fluid chamber, the motor end of the barrier fluid chamber being within the housing pump end;

a secondary shaft seal mounted in the barrier fluid chamber between the primary shaft seal and the outboard bearing, the secondary shaft seal sealing the barrier fluid in the barrier fluid chamber from well fluid on the exterior of the housing pump end and defining a pump end of the barrier fluid chamber;

a barrier fluid bellows having one side in contact with the barrier fluid in the barrier fluid chamber and an opposite side for contact with well fluid; wherein the barrier fluid bellows is movable between a contracted and an extended position; and the barrier fluid bellows has a spring rate selected to apply a positive pressure to the barrier fluid chamber that is greater than well fluid pressure on the exterior of the housing pump end.

9. A submersible pump assembly, comprising:

a motor for driving a pump of the pump assembly;

a dielectric motor lubricant in the motor;

a seal section operatively connected to the motor, the seal section comprising:

a housing having a housing motor end, a housing pump end, and a longitudinal axis;

a shaft in the housing that is driven by the motor;

a motor lubricant equalizing chamber in the housing between the housing pump end and the housing motor end;

a motor lubricant equalizer in the motor lubricant equalizing chamber;

a barrier fluid chamber in the housing pump end, the barrier fluid chamber containing a barrier fluid;

mechanical face primary and secondary shaft seals located within the barrier fluid chamber; and a barrier fluid equalizer having one side in contact with the barrier fluid in the barrier fluid chamber for equalizing pressure of the barrier fluid and well fluid on the exterior of the housing pump end.

10. The assembly according to claim 9, further comprising a guide tube in the motor lubricant equalizing chamber, the guide tube surrounding the shaft, defining a shaft annulus between the guide tube and the shaft.

11. The assembly according to claim 10, further comprising a lubricant communication path for the motor lubricant leading from the motor through the shaft annulus to the primary shaft seal, which seals the barrier fluid in the barrier fluid chamber from the motor lubricant and defines a motor end of the barrier fluid chamber; the secondary shaft seal being farther from the motor lubricant equalizing chamber than the primary shaft seal, the secondary shaft seal sealing the barrier fluid in the barrier fluid chamber from well fluid exterior of the housing pump end.

12. The assembly according to claim 9, further comprising:

an outboard bearing in the housing pump end in radial supporting engagement with the shaft; and an inboard bearing in the housing pump end, axially spaced from the outboard bearing, and in radial supporting engagement with the shaft; the primary and secondary shaft seals being axially located between the inboard and outboard bearings; the inboard bearing being in the motor lubricant communication path and immersed in the motor lubricant;

and the outboard bearing adapted to be immersed in well fluid exterior of the housing pump end.

13. The assembly according to claim 12, wherein: the outboard bearing is rigidly mounted in the housing pump end; and the inboard bearing is mounted for limited radial compliant movement relative to the housing pump end.

14. The assembly according to claim 9, wherein: the barrier fluid equalizer is movable between a contracted and an extended position and biased toward the extended position;

and the barrier fluid equalizer is configured to be in the contracted position when the assembly is first lowered into a well so as to apply a positive pressure to the barrier fluid chamber that is greater than well fluid pressure on the exterior of the housing pump end.

15. A submersible pump assembly, comprising:

a pump;

a motor containing a dielectric motor lubricant;

a seal section operatively connected between the pump and the motor, the seal section comprising:

a housing having a housing motor end, a housing pump end, and a longitudinal axis;

a coaxial shaft in the housing that is driven by the motor;

a motor lubricant equalizing chamber in the housing between the housing pump end and the housing motor end;

a motor lubricant equalizer in the motor lubricant equalizing chamber;

an outboard bearing in the housing pump end in radial supporting engagement with the shaft;

an inboard bearing in the housing pump end, axially spaced from the outboard bearing and in radial supporting engagement with the shaft;

a barrier fluid chamber in the housing pump end axially between the outboard bearing and the inboard bearing, the shaft extending through the barrier fluid chamber, the barrier fluid chamber containing a barrier fluid;

shaft seals located within the barrier fluid chamber in sealing engagement with the shaft axially between the inboard and outboard bearings; and a barrier fluid equalizer having one side in contact with the barrier fluid in the barrier fluid chamber for equalizing pressure of the barrier fluid and well fluid on the exterior of the housing pump end.

16. The assembly according to claim 15, wherein: the barrier fluid has a higher specific gravity than the motor lubricant.

17. The assembly according to claim 15, further comprising:

an outboard receptacle in the housing pump end and an inboard receptacle in the housing pump end;

wherein the outboard bearing comprises an outboard bushing of a carbide material, the outboard bushing being rigidly mounted within the outboard receptacle for non-rotation within the outboard receptacle;

the inboard bearing comprises an inboard bushing in non-rotating engagement with the inboard receptacle; and a resilient member between a circumferential exterior of the inboard bushing and a circumferential interior of the inboard receptacle, the resilient member allowing limited radial movement of the inboard bushing within the inboard receptacle.

18. The assembly according to claim 15, wherein:

the shaft seals comprise mechanical face primary and secondary shaft seals, and wherein each of the primary and secondary shaft seals comprises a mechanical face seal having a runner that rotates with the shaft and is urged by a diaphragm against a non-rotating base;

the base of the primary shaft seal is closer to the inboard bearing than the diaphragm of the primary shaft seal; and the base of the second shaft seal is closer to the outboard bearing than the diaphragm of the secondary shaft seal.

19. The assembly according to claim 18, further comprising:

a motor lubricant communication path for the motor lubricant leading from the motor through the motor lubricant equalizing chamber and the inboard bearing to the primary shaft seal, which seals the barrier fluid in the barrier fluid chamber from the motor lubricant and defines a motor end of the barrier fluid chamber; the secondary shaft seal being farther from the motor lubricant equalizing chamber than the primary shaft seal, the secondary shaft seal sealing the barrier fluid in the barrier fluid chamber from will fluid exterior of the housing pump end and defining a pump end of the barrier fluid chamber, and wherein, the barrier fluid equalizer is movable between a contracted and an extended position and biased toward the extended position; and the barrier fluid equalizer is configured to be in the contracted position when the assembly is first lowered into a well so as to apply a positive pressure to the barrier fluid chamber that is greater than well fluid pressure on the exterior of the housing pump end and greater than a motor lubricant pressure of motor lubricant within the motor.

* * * * *